US006119873A

United States Patent [19]

Matthews

[11] Patent Number: 6,119,873

[45] **Date of Patent: *Sep. 19, 2000**

[54] METHOD OF DISPLAYING SUPPORT PILLOWS

[75] Inventor: Susan H. Matthews, Evergreen, Colo.

[73] Assignee: Camp Kazoo, Ltd., Golden, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/838,915

[22] Filed: Apr. 11, 1997

[51] Int. Cl.[7] ..... A47F 7/00

[52] U.S. Cl. ..... 211/49.1; 211/59.1; 211/196; 211/205

[58] Field of Search ..... 211/49.1, 59.1, 211/196, 205

[56] References Cited

U.S. PATENT DOCUMENTS

| | | | |
|---|---|---|---|
| 584,906 | 6/1897 | Tribolet | 211/49.1 |
| 815,338 | 3/1906 | Farish et al. | 211/196 X |
| 911,280 | 2/1909 | Wixon | 211/59.1 |
| 911,785 | 2/1909 | Vasconcelles | 211/49.1 X |
| 935,507 | 9/1909 | Hill et al. | 211/59.1 |
| 1,174,360 | 3/1916 | Shindel | 40/607 X |
| 1,452,396 | 4/1923 | Sterner et al. | 40/607 |
| 1,504,421 | 8/1924 | Bishop | 211/49.1 |
| 1,797,221 | 3/1931 | Carter et al. | 40/607 X |
| 2,063,393 | 12/1936 | McIver | 211/49.1 |
| 2,538,612 | 1/1951 | Wuollet | 211/49.1 X |
| 2,626,062 | 1/1953 | Manzella | 211/59.1 |
| 2,924,338 | 2/1960 | Sharp | 211/205 X |
| 3,424,313 | 1/1969 | Feibelman | 211/205 X |
| 4,865,283 | 9/1989 | Parker | 248/159 |
| 4,919,278 | 4/1990 | Howen | 211/49.1 |
| 5,261,134 | 11/1993 | Matthews | 5/655 |

FOREIGN PATENT DOCUMENTS

| | | | |
|---|---|---|---|
| 711327 | 9/1931 | France | 211/59.1 |

*Primary Examiner*—Daniel P. Stodola
*Assistant Examiner*—Gregory J. Strimbu
*Attorney, Agent, or Firm*—Townsend and Townsend and Crew LLP

[57] ABSTRACT

A method of displaying a support pillow comprising the steps of providing a support pillow display stand comprising a base having a periphery and at least three vertically oriented shafts extending from the base, wherein the shafts are spaced about the periphery to define an open interior, introducing the support pillow into the open interior by squeezing the support pillow between two of the shafts and placing the support pillow on an upper surface of the display stand base between the three shafts.

4 Claims, 5 Drawing Sheets

METHOD OF DISPLAYING SUPPORT PILLOWS

BACKGROUND OF THE INVENTION

The present invention relates generally to the field of display stands, and in particular to support pillow display stands and methods for their use.

The commercial success of products often depends on the manner and location in which those products are displayed to the consuming public. Manufacturers and distributors often want their products displayed in store locations that are highly visible and easily accessible, such as on a shelf at eye-level and/or in a location subject to high consumer foot traffic. However, the effective placement and display of awkwardly shaped items, such as bulky or non-symmetrical products, can present unique problems.

Awkwardly shaped items can be difficult to arrange in a systemized manner. For example, they may be hard to stack on a conventional store shelf. As an alternative some have proposed to display bulky items in large bins. However, such bins can take up a significant amount of store floor space. Large display bins may also require the customer to hunt through piles of items before locating an item the customer wishes to purchase. Customers in a hurry may not bother to look for hard-to-locate products buried in a large bin or stored on a hard-to-reach top shelf with other bulky items.

One such category of awkwardly shaped items which are of particular interest are pillows, and particularly support pillows as described in U.S. Pat. No. 5,261,134 and U.S. Pat. No. 5,661,861, the complete disclosures of which are herein incorporated by reference. These support pillows, and others like them, are generally crescent-shaped with an open middle region. For example, the support pillow in U.S. application Ser. No. 08/590,653 has a medial region and two cantilever arms extending from the medial region to form a substantially toroidal configuration. Because of their unique and somewhat awkward shape, these pillows can be difficult to display using conventional methods such as shelves or bins.

Therefore, it would be desirable to display various support pillows in a manner which maximizes their visibility to potential consumers, makes selection of a pillow easier, and uses a minimal amount of store floor space.

In one aspect, it would be further desirable to provide a display stand system which can be moved easily from one location in a store to another. Such a system would allow the support pillows to be displayed at different locations depending on the needs of the store and consumers. It also would be desirable to display a number of pillows in an organized fashion to allow prospective purchasers to see pillows of different sizes and/or decorative coverings. It would be further desirable to display a number of pillows in a manner which would allow a purchaser to easily select any one of the pillows from the pillow display stand for closer inspection and/or purchase without having to search through a large pile of pillows.

SUMMARY OF THE INVENTION

The invention provides support pillow display stands and methods for their use. In an exemplary embodiment, the display stand comprises a base and at least one shaft having a proximal end and a distal end. The proximal end is attached to the base so that the shaft is vertically oriented. The distal end includes an attachment mechanism which is adapted to receive a sign. With this arrangement, a number of support pillows may be stacked on the base, with the shaft assisting in maintaining the stacked arrangement.

In one aspect, the shaft is removably attached to the base. By allowing the shaft and base to be separated, the display stand can be shipped more easily from one location to another or stored when not in use. Conveniently, the proximal end of the shaft is removably received within a hole in the base.

In a further aspect, the base is circular in shape, although other shapes may be used. A still further aspect provides that the center of mass of the base, the shaft, and the attachment mechanism is located at the base. In this manner, the display stand remains stable even when a number of support pillows are displayed.

In another aspect, at least two feet are attached to an underside of the base to create a vertical displacement between the base and a flat surface. One advantage of creating such a vertical displacement is that it allows the flat surface, such as a table top or floor, to be cleaned while the display stand remains in place.

In an additional aspect, the shaft is rigid and is constructed of a material such as a wood pole. The length of the pole is variable depending on the particular application. In one particular aspect, the pole has a length that is between about three feet and about ten feet and, more preferably, between about four feet and about seven feet.

In a further aspect, the attachment mechanism comprises a vertical slit in the distal end which is adapted to receive the sign. A bolt preferably extends through the shaft in a direction generally perpendicular to the slit. A nut is operably attached to the end of the bolt which when tightened constricts the vertical slit to hold the sign in place. In this manner, the nut can be tightened to hold a sign in place or loosened to remove and/or replace the sign. The sign held by the attachment mechanism will preferably contain information pertaining to the support pillows.

In one alternative aspect of the invention, at least three shafts are spaced about the periphery of the base. In this way, a number of support pillows may be stacked on the base with the shafts being arranged about the pillows to hold them in place.

The invention also provides an exemplary embodiment of a support pillow display stand system. The display stand system comprises a base and at least one shaft having a proximal end and a distal end. The proximal end is attached to the base so that the shaft is vertically oriented and an attachment mechanism, adapted to receive a sign, is located at the distal end. The system includes at least one support pillow comprising a medial region and two opposing arms. The support pillow rests on the base in close proximity to the shaft.

In a preferable aspect, the support pillow is removably received over the shaft. In this manner, the pillow can be removed from the display stand system for inspection or purchase by an interested consumer. In another aspect, a plurality of support pillows are removably received over the shaft in a stacked arrangement. This allows a consumer to choose a particular pillow from a number of support pillows displayed by the system. In addition, the stacked arrangement allows for the removal of any one pillow from the display stand system without having to search through a pile of pillows.

In one aspect, the proximal end of the shaft is removably received within a hole in the base to facilitate the shipping or storing of the display stand system. In another aspect, the base is circular in shape. In a further aspect, the center of mass of the base, the shaft, and the attachment mechanism is located at the base. Such a center of mass provides stability to the system when the support pillows are added or removed and during their display.

The shaft has a length that is variable depending upon the particular application. In one particular aspect, the shaft has a length that is between about three feet and about ten feet and, more preferably, between about four feet and about seven feet. Such a length allows a number of pillows to be displayed while providing order and stability to the stacked pillows. Additionally, such a length for the shaft facilitates the display of a sign at a height that is approximately eye level, allowing for easy viewing by potential customers.

In one alternative, at least three shafts are spaced about the periphery of the base such that the support pillow is removably held between the shafts. In this way, a plurality of support pillows may be removably held between the shafts in a stacked arrangement.

The invention further includes a preferred method for displaying support pillows. According to the method, a support pillow display stand is provided comprising a base and at least one shaft having a proximal end and a distal end. The shaft's proximal end is attached to the base so that the shaft is vertically oriented. The method includes providing at least one support pillow comprising a resilient cushion body having a medial region and first and second opposing cantilever arms. The arms extend from the medial region to define an open well. The support pillow is placed on the upper surface of the display stand base so that the shaft extends upwardly through the open well.

In one aspect of the method, an attachment mechanism, adapted to receive a sign, is provided at the distal end. In a further aspect, the first and second arms of the support pillow are distanced in order to place the arms around the shaft. In this manner, a support pillow which has arms that abut or overlap at the end can be displayed by distancing the arms, placing the support pillow around the shaft, and releasing the arms. In one exemplary aspect, a plurality of support pillows are stacked one on top of each other, such that the shaft extends upwardly through the open wells of the pillows.

In yet another exemplary method for displaying support pillows, a support pillow display stand is provided comprising a base and at least three vertically oriented shafts extending from the base. The shafts are spaced about the periphery to define an open interior. At least one support pillow is provided, comprising a resilient cushion body having a medial region and first and second opposing cantilever arms extending from the medial region. The support pillow is introduced into the open interior so that it rests on an upper surface of the display stand base between the three shafts.

In one aspect of the method, an attachment mechanism is provided at the distal end of at least one shaft which is adapted to receive a sign. In another aspect, the support pillow is compressed so as to fit between two of the shafts to introduce the support pillow into the open interior. In still another aspect, a plurality of support pillows are stacked one on top of each other such that the stack of support pillows is contained within the open interior. In this manner, a number of pillows can be displayed simultaneously.

DETAILED DESCRIPTION OF THE SPECIFIC EMBODIMENTS

Figure 1:
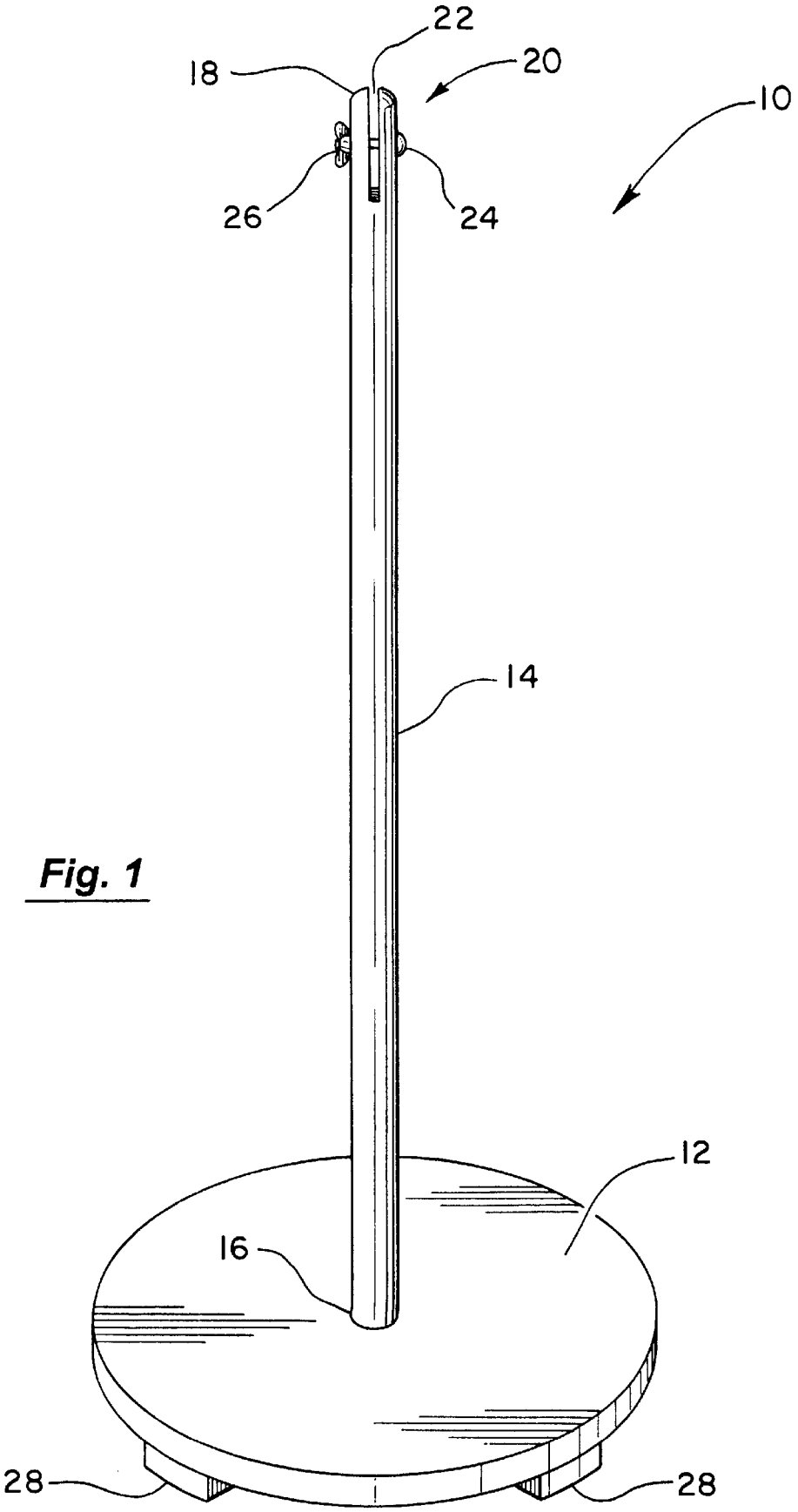
FIG. 1 is a perspective view of a support pillow display stand constructed in accordance with the present invention.

Referring to FIG. 1, an exemplary embodiment of a support pillow display stand 10 will be described. The display stand 10 may be constructed to display a large variety of support pillows, including those described in U.S. Pat. No. 5,261,134 and U.S. Pat. No. 5,661,861, previously incorporated herein by reference. The display stand 10 comprises a base 12 which can be configured in a variety of shapes and sizes. In FIG. 1, the base 12 is shown to be generally circular in shape. The display stand 10 further includes a shaft 14 having a proximal end 16 and a distal end 18. The proximal end 16 is attached to the base 12 such that the shaft is vertically oriented. The proximal end 16 can be attached to the base in a variety of ways, including, but not limited to, inserting the proximal end 16 into a hole in the base 12. Shaft 14 is preferably removable from base 12, which allows the display stand 10 to be shipped or stored more easily.

The distal end 18 of shaft 14 includes an attachment mechanism 20. As shown in FIG. 1, the attachment mechanism 20 comprises a vertical slit 22 in the distal end 18 of shaft 14. The attachment mechanism 20 further includes a bolt 24 extending through the shaft 14 in a direction generally perpendicular to slit 22. A nut 26 is operably attached to the end of bolt 24. Nut 26 is tightened to constrict slit 22 thereby providing a way to attach signs and the like to the distal end 18. Such an attachment mechanism 20 allows for the easy replacement and/or removal of signs. In addition to the attachment mechanism 20 depicted in FIG. 1, a number of other ways to attach a sign can be practiced within the scope of the present invention, such as by using a clamp, velcro, an elastic band and the like.

The base 12 includes a plurality of feet 28. Feet 28 provide a vertical displacement between the bottom of base 12 and a flat surface on which the display stand 10 is placed. One advantage of the feet 28 is to allow for the flat surface to be cleaned without having to move the display stand 10.

Figure 2:
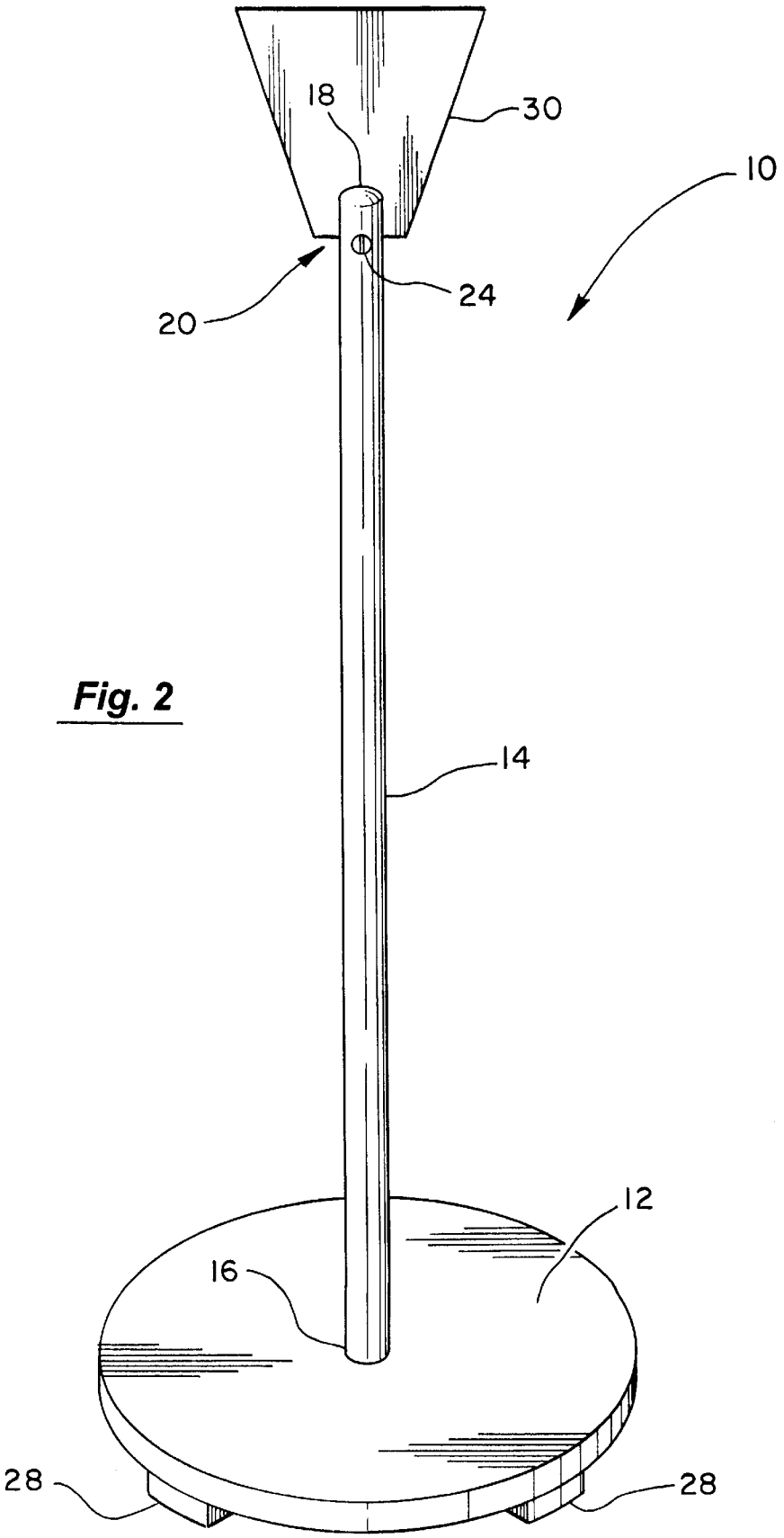
FIG. 2 illustrates the display stand of FIG. 1 having a sign attached thereto.

FIG. 2 depicts the same display stand 10 as shown in FIG. 1, with the addition of a sign 30. Sign 30 has been attached to the distal end 18 of shaft 14 by the attachment mechanism 20. Bolt 24 holds the sign 30 in place by constricting the slit 22 (as shown in FIG. 1). Sign 30 will typically depict information and/or pictorial representations of the support pillows displayed on the display stand 10.

Figure 3:
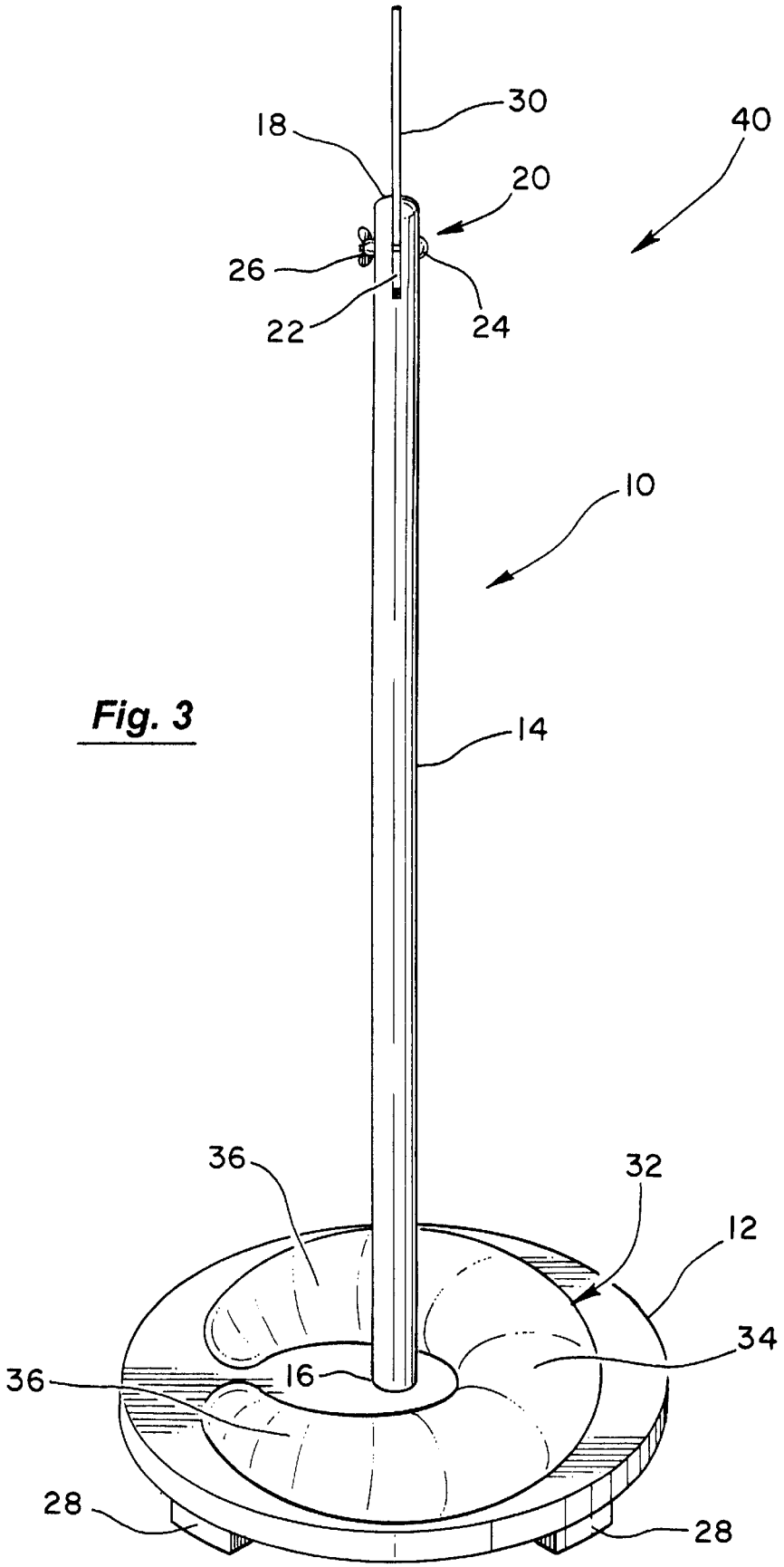
FIGS. 3 and 3A illustrate the display stand of FIG. 2 holding a single support pillow and several support pillows, respectively.

Turning now to FIG. 3, an exemplary display stand system 40 will be described. The display stand system 40 includes a display stand 10 as described in conjunction with FIGS. 1 and 2, and at least one support pillow 32. The support pillow 32 shown in FIG. 3 includes a medial region 34 and two cantilever arms 36, and may be constructed similar to the pillow described in U.S. application Ser. No. 08/590,653. The support pillow 32 rests on the top of base 12 in close proximity to shaft 14. To display the support pillow 32, the cantilever arms 36 are removably received around shaft 14. Depending on the relationship of the cantilever arms 36 and the general shape of the support pillow 32, the cantilever arms 36 may need to be distanced from each other in order to be received around the shaft 14.

In addition, some support pillows 32 may optionally comprise cantilever arms 36 which are sufficiently distanced in their normal state so as to allow those support pillows' cantilever arms 36 to be received around shaft 14 without the need for further distancing.

Figure 3A:
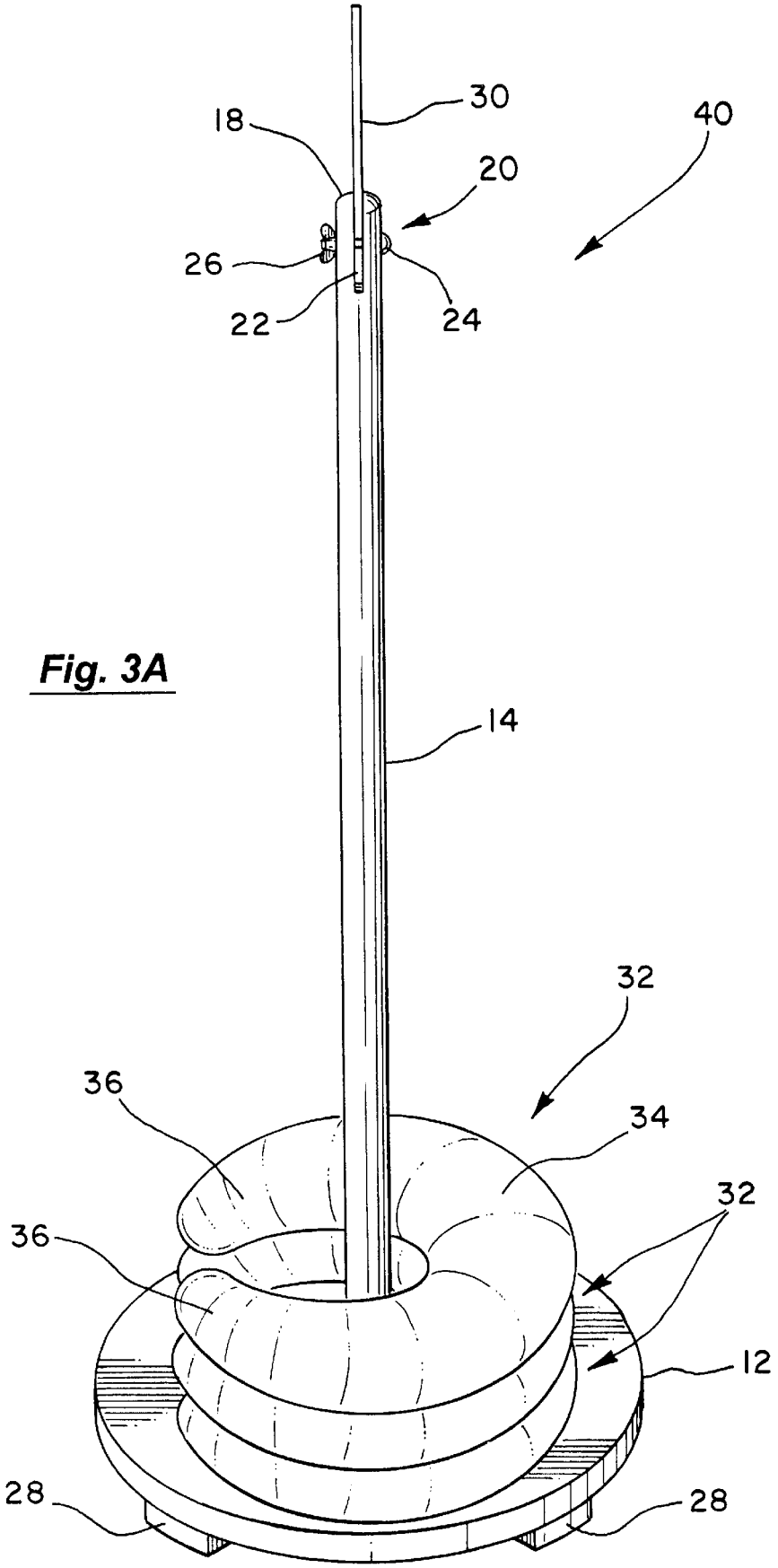

The display stand system 40 in FIG. 3 may be used to display a plurality of support pillows 32. As shown in FIG. 3A, the support pillows 32 can be displayed one on top of each other in a stacked configuration. In this manner, a number of support pillows 32 can be displayed at one time, thereby providing a consumer the convenience of selecting an appropriate support pillow 32 for further inspection or purchase. While the length of shaft 14 can vary depending upon the application, shaft 14 preferably has a length between about three feet and about ten feet and, more preferably, between about four feet and about seven feet. At this length, a plurality of support pillows 32 can be displayed simultaneously on a single display stand 10. This can be especially advantageous when the display stand system 40 is displaying a number of support pillows 32 of varying sizes and/or colors. Such a shaft length also places the sign at approximately the viewer's eye level.

The display stand system 40 depicted in FIGS. 3 and 3A offers a number of advantages. First, because of its fairly compact size (relative to a large display bin), the display stand system 40 can be moved easily from one location to another. Further, a number of pillows 32 may be displayed without occupying a large amount of store floor space. The display stand system 40 also displays the pillows 32 in an organized, stacked manner, which allows consumers to view a number of pillows 32 simultaneously. This is particularly helpful when the pillows 32 are of different sizes and/or have different cover designs. In addition, the sign 30 attached to the distal end 18 is located several feet above the floor or flat surface on which the display stand 10 is placed, thereby prominently displaying information on the support pillows 32 to prospective purchasers.

Figure 4:
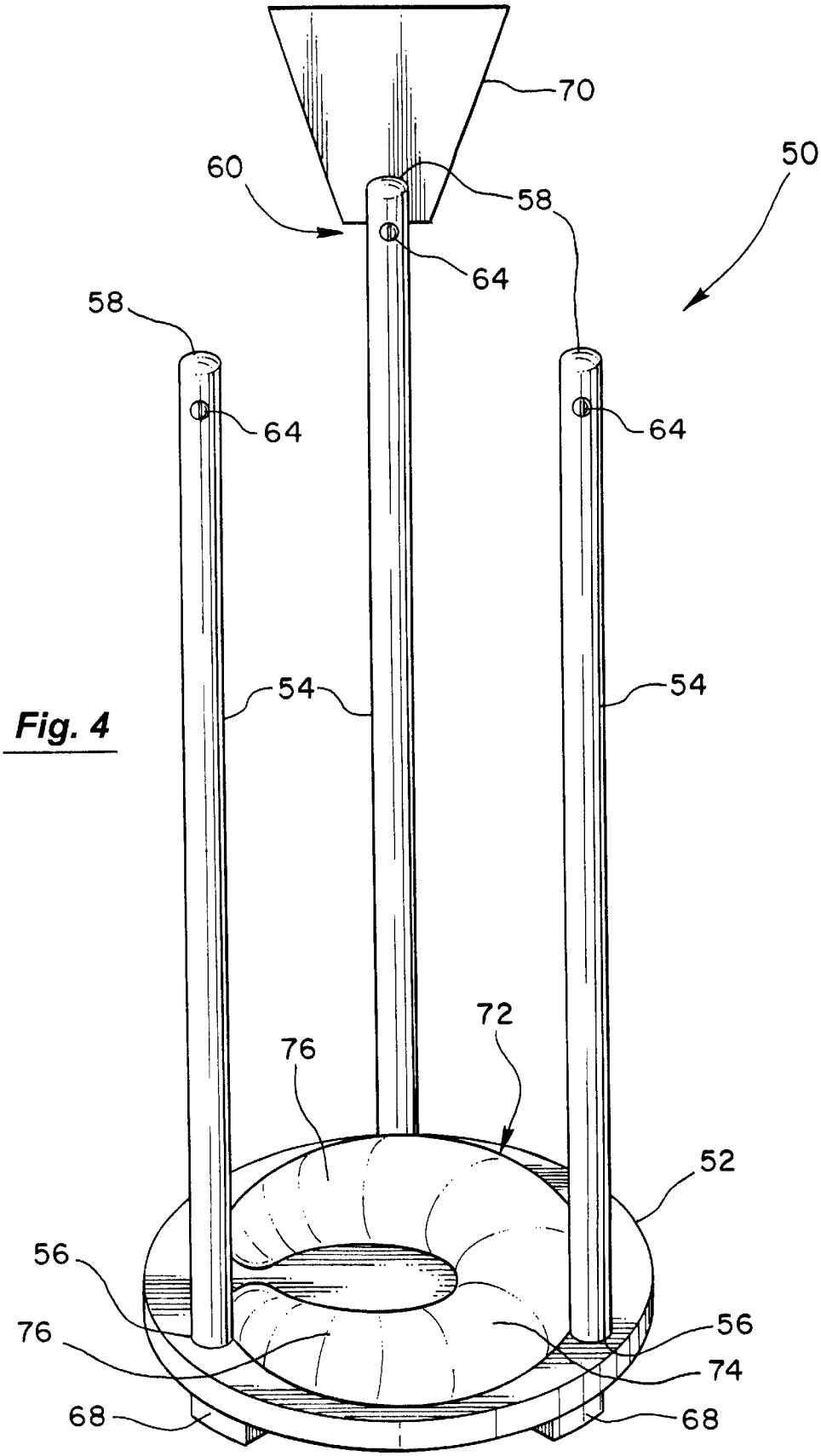
FIG. 4 is a perspective view of an alternative embodiment of a support pillow display stand system according to the present invention.

FIG. 4 depicts an alternative embodiment of a display stand system 50. The display stand system 50 includes three vertically oriented shafts 54 attached to a single base 52. As shown in FIG. 4, base 52 preferably has a plurality of feet 68. While FIG. 4 shows an embodiment with three shafts 54, more than three shafts 54 could be used within the scope of the present invention. The shafts 54 are spaced about the periphery of the base 52 and are sufficiently spaced so as to allow a support pillow 72 to be placed between the three shafts 54 and rest on top of the base 52. Each shaft 54 has a proximal end 56 attached to the base 52 and a distal end 58. At least one of the shafts 54 includes an attachment mechanism 60 to hold a sign 70 in place. In FIG. 4, all three shafts 54 include an attachment mechanism 60, however only one attachment mechanism 60 is being used to hold a sign 70. As with the attachment mechanism 20 in FIGS. 1 through 3, a nut 64 is constricting a vertical slit (not shown in FIG. 4) in the distal end 58 to hold the sign 70 in place. The sign 70 typically contains information pertaining to the support pillows 72 and/or pictorial representations of the support pillows 72 and their possible uses.

The display stand system 50 in FIG. 4 further includes a support pillow 72 comprising a medial region 74 and two cantilever arms 76. The support pillow 72 rests on top of base 52. Depending on the number of shafts 54 and their spacing and the size of the support pillow 72, the support pillow 72 may need to be constricted or rotated into a vertical orientation in order to fit between two of shafts 54 prior to being placed onto the base 52. While not shown in FIG. 4, the display stand system 50 can also include a plurality of support pillows 72 displayed in a stacked arrangement one on top of each other. In this manner, a large number of support pillows 72 can be displayed at a single time, thereby providing a prospective purchaser a choice of support pillows 72. The advantages of this display stand system 50 are similar to those advantages described in connection with FIGS. 1 through 3A.

The invention has now been described in detail. However, it will be appreciated that certain changes and modifications may be made. Therefore, the scope and content of this invention are not limited by the foregoing description. Rather, the scope and content are to be defined by the following claims.

What is claimed is:

1. A method of displaying a support pillow, comprising the steps of:

providing a support pillow display stand comprising a base having a periphery, at least three vertically oriented shafts extending from the base, wherein the shafts are spaced about the periphery to define an open interior;

said support pillow comprising a resilient cushion body having a medial region and first and second opposing cantilever arms extending from the medical region; introducing said support pillow into the open interior by squeezing said support pillow between two of said shafts; and placing said support pillow on an upper surface of the display stand base between the three shafts.

2. A method as in claim 1, further comprising providing an attachment mechanism at a distal end of at least one of said shafts, said attachment mechanism being adapted to receive a sign.

3. A method as in claim 1, wherein said introducing step comprises compressing the support pillow so as to fit between said two of the shafts.

4. A method as in claim 1, further comprising providing a plurality of said support pillows, and wherein said introducing and placing steps comprise introducing said plurality of support pillows into said open interior and placing said plurality of support pillows in a stacked arrangement such that the stack of said plurality of support pillows is contained within the open interior.

* * * * *